US005266187A

United States Patent [19]

Horecky et al.

[11] Patent Number: 5,266,187

[45] Date of Patent: Nov. 30, 1993

[54] METHOD FOR CATALYTIC CRACKING WITH POST-CYCLONE INERTIAL SEPARATOR

[75] Inventors: Carl J. Horecky, Friendswood, Tex.; Francis J. Citek, Naperville, Ill.

[73] Assignee: Amoco Corporation, Chicago, Ill.

[21] Appl. No.: 885,632

[22] Filed: May 19, 1992

[51] Int. Cl.[5] ..... C10G 11/00; C10G 11/18

[52] U.S. Cl. ..... 208/161; 208/113

[58] Field of Search ..... 208/113, 161; 422/147

[56] References Cited

U.S. PATENT DOCUMENTS

| | | | |
|---|---|---|---|
| 4,364,905 | 12/1982 | Fahrig et al. | 422/144 |
| 4,711,712 | 12/1987 | Schatz | 208/161 |
| 4,714,541 | 12/1987 | Buyan et al. | 208/113 |
| 4,792,437 | 12/1988 | Hettinger, Jr. et al. | 208/161 |
| 4,963,328 | 10/1990 | Haddad et al. | 422/144 |
| 4,971,681 | 11/1990 | Harandi et al. | 208/113 |
| 4,990,314 | 2/1991 | Herbst et al. | 422/144 |
| 5,032,251 | 7/1991 | Owen et al. | 208/113 |
| 5,039,397 | 8/1991 | Haddad et al. | 208/161 |

*Primary Examiner*—Theodore Morris
*Assistant Examiner*—Walter D. Griffin
*Attorney, Agent, or Firm*—Scott P. McDonald; Richard A. Kretchmer

[57] ABSTRACT

A generally closed vapor path catalytic cracking reactor system is disclosed which includes a vented post-cyclone inertial separator. The inertial separator includes first and second conduit-like members and a vent located at the downstream end of the upstream member. Spent catalyst can be disengaged from a spent catalyst and cracked vapor mixture through the vent while cracked hydrocarbon vapors flow into the second separator member. The separator vent provides a path for stripping gas to enter the generally closed vapor path under routine operating conditions and provides a flow path for damping pressure surges into a surrounding disengagement vessel under transient quality conditions.

13 Claims, 3 Drawing Sheets

METHOD FOR CATALYTIC CRACKING WITH POST-CYCLONE INERTIAL SEPARATOR

FIELD OF THE INVENTION

The invention relates to methods useful for catalytically cracking hydrocarbons and separating the cracked hydrocarbons from the cracking catalyst. More particularly, the invention relates to a catalytic cracking reactor system having a generally closed vapor path and which employs an inertial separator located downstream of a cyclone separator to mitigate the effects of reactor pressure transients.

BACKGROUND OF THE INVENTION

Efficient use of petroleum feedstock requires a refiner to convert relatively high molecular weight hydrocarbons to more valuable lower molecular weight gasoline range hydrocarbon materials. Catalytic cracking is one process used to produce the more valuable gasoline range materials.

Modern catalytic cracking processes typically react hydrocarbon vapors with a hot zeolitic cracking catalyst in a fluidized riser reactor. The cracking reaction occurs as the catalyst and feedstock rise through the riser reactor, with a reaction mixture of predominantly spent catalyst and lower molecular weight hydrocarbons being discharged from the upper end of the reactor. After rising through the reactor, spent catalyst must be separated from the reaction mixture so that the cracked hydrocarbon products can be further processed and so that spent catalyst can be regenerated and reused.

In open vapor path catalytic cracking systems such as those disclosed in U.S. Pat. Nos. 4,390,503, 4,500,423, 4,606,814 and 4,701,307, an initial catalyst disengagement step typically is accomplished by discharging spent catalyst from the upper end of the riser reactor into a volumetrically large disengagement vessel which surrounds the system. In such a system, the momentum of discharged catalyst particles causes the particles to shoot upwardly through a dilute phase fluidized upper region of the vessel and then settle downwardly into a dense phase fluidized lower region of the vessel. A mixture of cracked hydrocarbon vapors and some spent catalyst passes from the dilute phase of the system into one or more cyclone separators, or "cyclones". The cyclones cyclonically remove spent catalyst not removed in the initial disengagement step and discharge a further catalyst-depleted mixture into a generally closed vapor path leading into the reactor outlet plenum and then out of the vessel, with the catalyst collected by each cyclone flowing down to the catalyst dense bed through a cyclone bottom outlet. At the same time, the dense phase bed of accumulating catalyst is stripped of entrained hydrocarbon vapors by passing stripping steam through the bed. This stripping process releases a mixture of stripped vapors and stripping steam, or "stripping gas", into the dilute phase vessel volume located above the dense bed. The stripping gas entering the dilute phase enters the cyclones along with the dilute phase materials already discussed.

Open vapor path systems like those just described provide the advantage of damping pressure and catalyst surges known to occur in catalytic cracking riser reactors. Causes of these surges include normal catalyst flow irregularities, equipment malfunctions, the sudden vaporization of water present in feedstock, and various other unit pressure upsets. Because these riser surges are damped into the volumetrically large disengagement vessel before the reaction products enter the secondary separation equipment, the surges do not propagate through the secondary separation equipment and degrade the separation efficiency of downstream devices as they otherwise would if not damped into the vessel volume.

Unfortunately, the design of open vapor path systems has been found to contribute to the undesired secondary thermal cracking of gasoline range materials when operated in the 1000 degree plus Fahrenheit temperature range common in modern catalytic cracking reactor systems. Because the cracked products mix with the large disengagement vessel volume before being withdrawn from the vessel by the secondary separation equipment, the cracked products can reside in the vessel long enough at high enough temperatures to significantly affect product yield. For example, estimates show that as much as ten percent of the desired gasoline range products can be lost if these products are exposed to temperatures of 1100° F. for as little as 4 to 5 seconds. Furthermore, the presence of cracking catalyst in the dilute phase of the unit can lead to overcracking of hydrocarbon vapors in that region.

To prevent undesired overcracking and secondary thermal cracking, some refiners have turned to closed vapor path systems in which reaction products pass along a closed vapor path from a riser reactor directly to catalyst disengagement equipment. Such closed systems may reduce overcracking because cracked hydrocarbon vapors and spent catalyst are immediately discharged into a cyclone separator, thereby potentially effecting a rapid catalyst disengagement. The system may also reduce thermal cracking because vapors are not discharged into the relatively large disengagement vessel with its associated long gas residence times. One such representative closed vapor path system is that disclosed in Haddad, U.S. Pat. No. 4,502,947.

While the use of closed systems such as Haddad's may minimize undesired thermal cracking and overcracking, closed systems can suffer from an inability to mitigate the effects of pressure and catalyst surges. Specifically, because surges no longer vent into a large disengagement vessel volume, surges propagate through secondary separation equipment such as cyclones, thereby disrupting the motion of materials inside the equipment. This disruption reduces the separation equipment's separation efficiency and can cause substantial quantities of cracking catalyst to propagate downstream of the separation equipment. In some instances, cracking catalyst can propagate beyond the catalyst separation equipment, leading to post-separator cracking and contamination of fractionator feedstreams, thereby impacting process operability.

One potential method for dealing with unwanted surges in closed systems is to employ a mechanical solution such as the surge activated trickle valves disclosed in U.S. Pat. Nos. 4,581,205 and 4,588,558. This method may permit surges to be vented into a large disengagement vessel volume, but is undesirable because it increases the mechanical complexity of the separation equipment and because it requires the continued operation of mechanical devices in the thermally severe and erosive catalytic cracking environment.

Another potential solution to surge and secondary cracking problems is to employ an "open-bottomed"

cyclone design as disclosed by Farnsworth in U.S. Pat. No. 4,478,708. In this design, catalytically-cracked products and spent catalyst follow a closed vapor path into a cyclone having a bottom which opens into a relatively large disengagement vessel volume. Catalyst is cyclonically separated in the cyclone in much the same manner as in closed cyclones well known in the art. However, instead of falling into a dipleg, separated catalyst simply falls through the open cyclone bottom into the lower portion of the disengagement vessel for stripping and collection. Catalyst-depleted gas passes from the top of the cyclone through secondary separation cyclones as in many traditional closed-bottomed cyclone systems.

Farnsworth's design seems to succeed because the lower pressure downstream of his open-bottomed cyclone causes the cyclone to appear to be a closed vapor path for gases even though the bottom of the cyclone is open. Only when cyclone inlet pressure increases significantly, such as under surge conditions, does the open bottom appear to offer a vapor path into the large disengagement vessel volume. Thus, Farnsworth's design may represent an improvement over the other designs already discussed.

While Farnsworth's open-bottomed cyclone design may provide a partial solution to the surge and secondary cracking problems inherent in closed-vapor path catalytic cracking operations, his design suffers from a serious disadvantage that stems from the use of the open-bottomed cyclone as the primary solids disengagement device. Specifically, while separated catalyst is falling downwardly toward the open bottom, stripping gas simultaneously must flow up into the cyclone's open bottom. This countercurrent flow of catalyst and vessel vapors in a cyclone can cause separated catalyst to become reentrained in the entering stripping gas, thereby reducing the efficiency of the separator. This problem is particularly acute in heavily-loaded cyclones such as Farnsworth's where the lack of a pre-cyclone disengagement device requires that much of the inventory of cracking catalyst must be discharged through the open bottoms of the cyclones. While improvements to open bottom cyclone systems are disclosed in our commonly assigned U.S. applications having Ser. No. 07/815,281 and 07/815,286, refiners also desire improved non-open bottom cyclone system designs.

What is needed is a generally closed vapor path catalytic cracking reactor system which can reduce undesired thermal cracking, minimize the effects of pressure transients, and which does not require stripping gas to pass countercurrently through large fractions of the circulating cracking catalyst inventory under non-surge conditions.

SUMMARY OF THE INVENTION

It is an object of the invention to provide an improved catalytic cracking reactor system.

It is a further object of the invention to provide a catalytic cracking reactor system which provides a generally closed cracked product vapor path while simultaneously minimizing the effects of system pressure transients and admitting stripping gas into a lightly-loaded region of the system.

It is another object of the invention to provide a generally closed vapor path catalytic cracking reactor system which can accommodate pressure surges by employing non-cyclonic separation equipment downstream of a cyclone separator.

Other objects of the invention will become apparent as discussed herein.

The aforestated objects of the invention can be accomplished by introducing heated cracking catalyst and a hydrocarbon feedstock into a riser reactor; allowing the catalyst and feedstock to react as they rise toward an outlet end of the riser reactor; passing a reaction mixture of cracked vapors and spent catalyst along a generally closed vapor path from the riser reactor outlet end through a first cyclone separator to produce a catalyst-depleted reaction mixture; and passing the catalyst-depleted reaction mixture through a vented inertial separator located downstream of the first cyclone separator to create a further catalyst-depleted reaction mixture.

In some embodiments, a second cyclone separator is provided after the inertial separator to remove catalyst which has passed through the first cyclone and the inertial separator. In other embodiments, the reaction mixture undergoes an initial non-cyclonic separation step before passing through the first cyclone.

By providing an inertial separator downstream of a primary cyclone, stripping gases can enter the cracked product stream under non-surge conditions without having to pass through heavily catalyst-loaded regions such as the open bottom of an open-bottomed cyclone separator. This minimizes reentrainment of separated solids in entering stripping gas.

The use of a post-cyclone inertial separator also permits catalyst particles escaping a first cyclone separator to pass into the disengagement vessel volume while providing a relatively closed path for cracked product vapors, thereby providing a further catalyst-depleted vapor stream while minimizing unwanted thermal cracking.

Under surge conditions, the inertial separator permits surging reaction mixture to be discharged into the disengagement vessel volume, thereby mitigating the pressure transient and its effects on downstream separation equipment and minimizing carryover of catalyst into the fractionator feedstream. Because the inertial separator does not require established cyclonic flow to function effectively, the separator mitigates pressure transient effects that otherwise would propagate through flow-disrupted systems employing series-connected cyclone separators.

DETAILED DESCRIPTION OF THE INVENTION

FIGS. 1–5 illustrate alternative embodiments of catalytic cracking reactor systems in accordance with the present invention. In each FIGURE, like numbers refer to like parts. Each embodiment includes an inertial separator located downstream of a cyclone separator and within a disengagement vessel. While FIGS. 1-5 illustrate several systems particularly useful for catalyst disengagement in catalytic cracking operations, it should be understood that the invention is not limited to these particular embodiments or applications and that many modifications and alternative embodiments of the invention will be apparent to those skilled in the art after viewing the invention disclosed herein.

Figure 1:
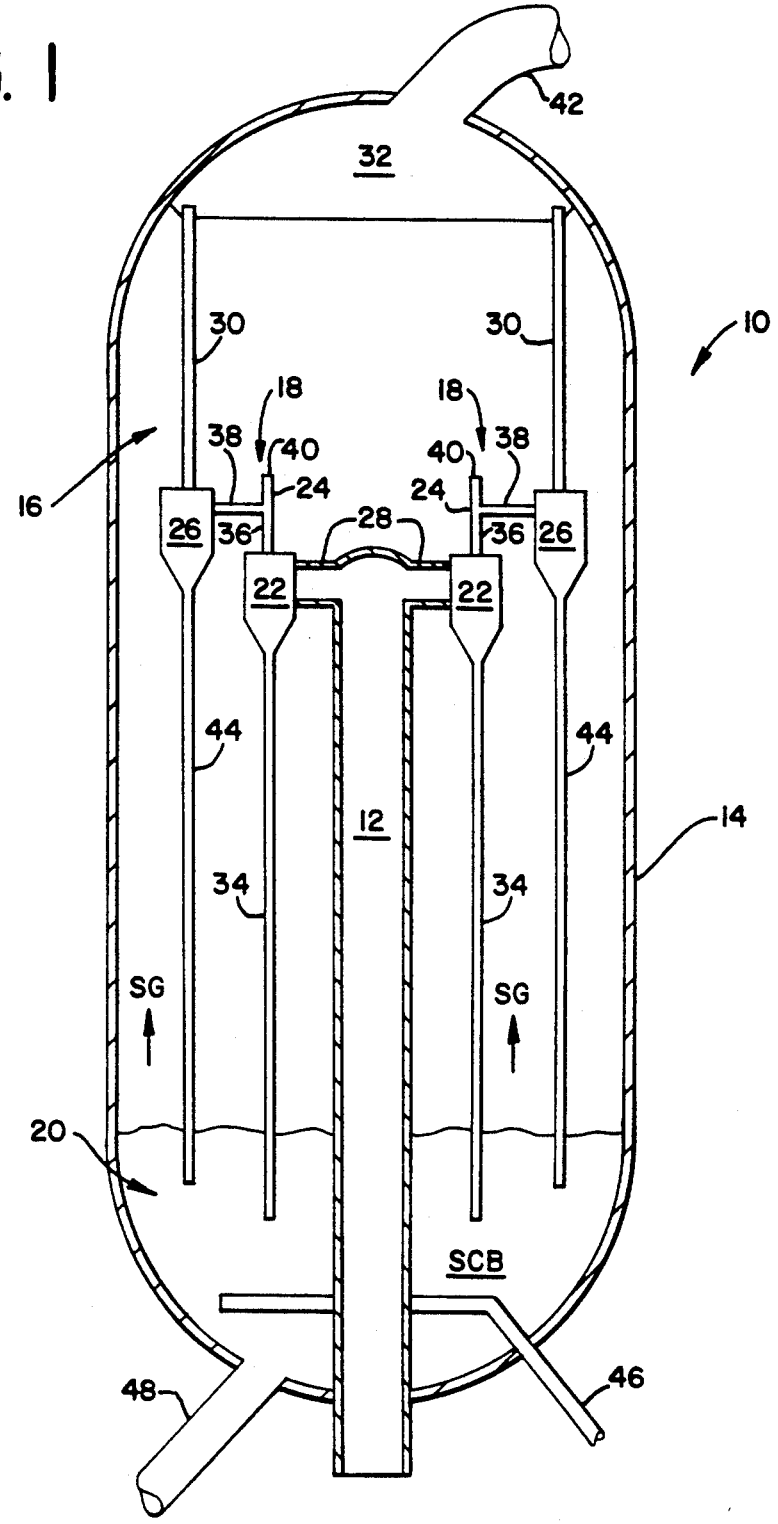
FIG. 1 is a sectional view of a catalytic cracking reactor system and associated disengagement equipment in accordance with the present invention.

Referring first to FIG. 1, a catalytic cracking reactor system 10 includes a riser reactor 12 located generally along the longitudinal centerline of a disengagement vessel 14. During operation, hot catalyst and relatively high molecular weight hydrocarbon feedstock such as gas oil is introduced at or near the bottom of reactor 12. The hot catalyst vaporizes the hydrcarbon feedstock and the mixture is propelled upwardly through reactor 12 as a dilute phase fluidized bed. The feedstock and catalyst react while rising through reactor 12, being converted to a reaction mixture of predominantly spent catalyst and cracked hydrocarbon vapors by the time these materials reach the upper end of reactor 12.

Figure 4:
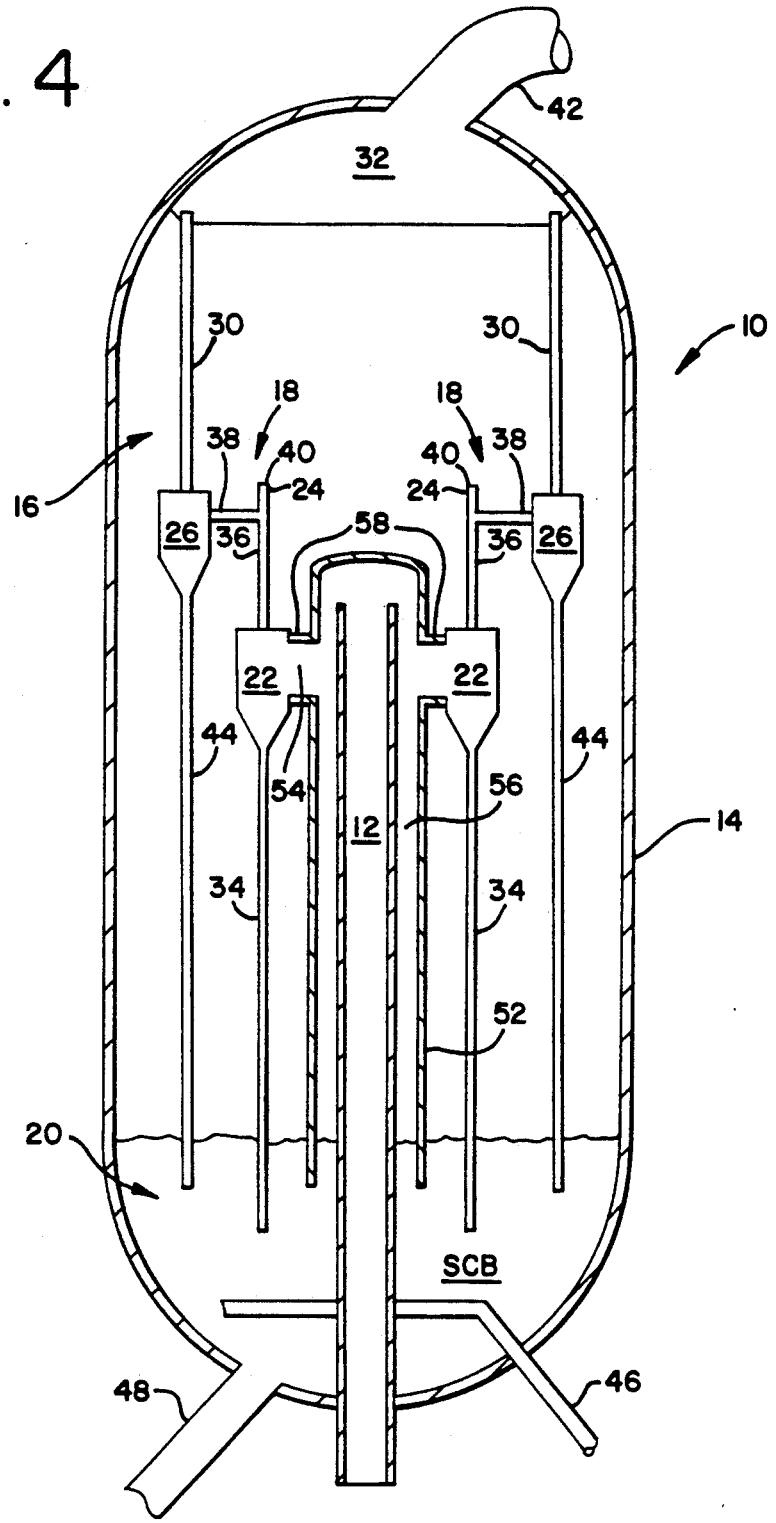
FIG. 4 is a sectional view of another embodiment of a catalytic cracking reactor system in accordance with the present invention.

Vessel 14 has an upper region 16 containing various catalyst disengagement equipment 18 in accordance with the present invention and a lower region 20 in which spent catalyst SC accumulates in a dense phase fluidized spent catalyst bed SCB as discussed below. As illustrated, two trains of disengagement equipment 18 each include a primary cyclone 22, an inertial separator 24, a secondary cyclone 26, a reactor discharge pipe 28 for providing a closed vapor path between reactor 12 and primary cyclone 22, and a secondary cyclone outlet pipe 30 extending into a reactor discharge plenum 32 for providing a closed vapor path between cyclone 26 and plenum 32. It should be noted that while two trains of disengagement equipment are illustrated in FIGS. 1 and 4, the number of disengagement equipment trains is not critical as long as the cumulative capacity of the trains is sufficient to accommodate the flow exiting riser reactor 12. If additional trains are employed, the trains should be oriented in a generally radially symmetric orientation about riser reactor 12.

Figure 2:
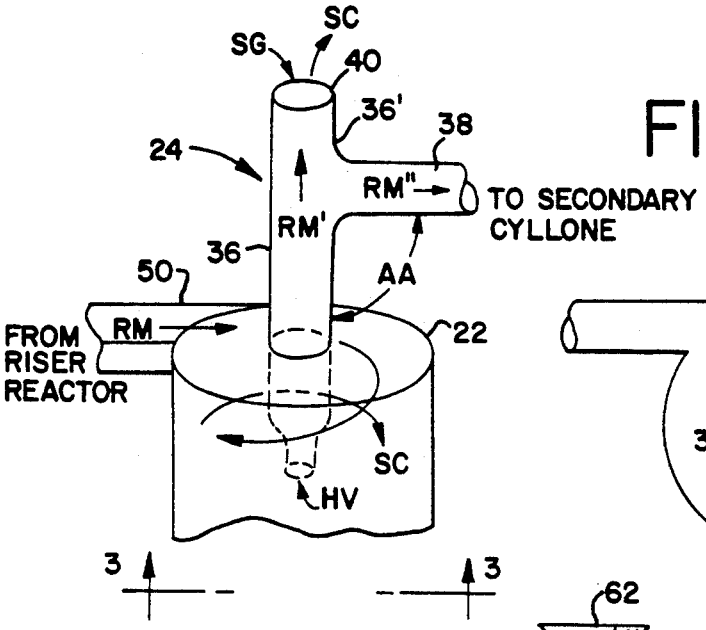
FIG. 2 is a perspective view of an inertial separator employed in the system shown in FIG. 1.

Catalyst-depleted cracked hydrocarbon vapors move through disengagement equipment 18 toward discharge plenum 32. Referring now to FIGS. 1 and 2, after reacting and rising through riser reactor 12, a reaction mixture RM (see FIG. 2) comprising spent catalyst SC and cracked hydrocarbon vapors HV is discharged from reactor 12 through reactor discharge pipes 28 and immediately enters primary cyclones 22. Cyclones 22 cyclonically separate spent catalyst SC from reaction mixture RM, causing spent catalyst SC to fall through primary cyclone diplegs 34 into spent catalyst bed SCB. While diplegs 34 are shown submerged in bed SCB, diplegs 34 can terminate above bed SCB if diplegs 34 are fitted with trickle valves as is well known in the art.

Catalyst-depleted reaction mixture RM' flows from cyclones 22 through inertial separators 24. Separators 24 include a first generally vertical member 36, a second generally horizontal member 38, and a vent 40. As discussed below, vent 40 provides a path for catalyst particles to exit separator 24 as well as a path for stripping gas to enter system 10. Further catalyst-depleted reaction mixture RM" exiting separators 24 flows through secondary cyclones 26, outlet pipes 30, reactor outlet plenum 32 and out a plenum discharge pipe 42. Solids separated by secondary cyclones 26 pass into spent catalyst bed SCB through diplegs 44.

Because spent catalyst separated by disengagement equipment 18 contains a significant quantity of entrained hydrocarbon vapors, stripping steam supplied by a steam line 46 is passed through spent catalyst bed SCB to strip hydrocarbon vapors from the spent catalyst. The steam and stripped hydrocarbon vapors, hereafter collectively referred to as stripping gas SG, pass into upper region 16 of vessel 14. Stripped spent catalyst can be removed through catalyst removal line 48 for regeneration and reuse as is well known in the art.

Stripping gas SG discharged into upper vessel region 16 moves into inertial separator vents 40 because of a pressure differential present across vents 40. Stripping gas SG mixes with the catalyst-depleted reaction mixture RM' within separators 24 and passes through the remainder of system 10 along with reaction mixture RM".

Figure 3:
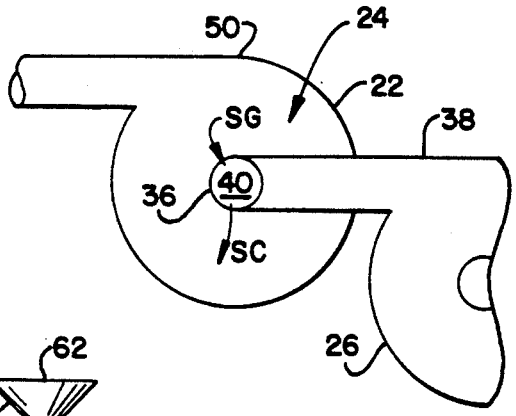
FIG. 3 is a plan view of the separator of FIG. 2.

FIGS. 2 and 3 illustrate inertial separator 24 in greater detail. Vertical separator member 36 penetrates the top of first cyclone 22 and extends downwardly within cyclone 22 to a point lower than the lower end of cyclone inlet volute 50. Inertial separator vent 40 is located at the upper (and downstream) end section 36' of vertical member 36 and has an inner diameter roughly equal to that of upper member 36. Horizontal separator member 38 extends generally horizontally toward secondary cyclone 26 from vertical member 36 at a point below vent 40 but above the top of cyclone 22. Members 36 and 38 define an included angle AA which in this case is about 90 degrees but may vary as described below. Horizontal member 38 translates into or is otherwise connected to an inlet volute for second cyclone 26 (see FIG. 3).

The operation of separator 24 under non-surge conditions is straightforward. As reaction mixture RM is tangentially introduced to cyclone 22, spent catalyst SC begins to rotate and become separated from reaction mixture RM. As reaction mixture RM becomes catalyst-depleted, hydrocarbon vapors HV and a non-separated portion of spent catalyst SC move upwardly into vertical separator member 36. Because the upwardly moving catalyst particles SC possess a significant amount of upward momentum, particles SC continue to move upwardly through vertical member 36 and out vent 40 while the relatively momentumless hydrocarbon vapors move through horizontal member 38 towards secondary cyclone separator 26. Concurrently, stripping gas SG from disengagement vessel 14 enters vent 40 and passes through horizontal member 38 toward secondary cyclone 26. Unlike some other systems in which stripping gas SG must pass countercurrently through a large spent catalyst flow discharged from a heavily-loaded separator, stripping gas SG must pass countercurrently through only the fraction of spent catalyst SC disengaged by separator 24.

Under surge conditions, separator 24 can mitigate pressure transients introduced into the generally closed vapor path present between riser reactor 12 and reactor discharge plenum 32. Under these conditions, the pressure present upstream of inertial separator 24 may become great enough to disrupt cyclonic flow in cyclone 22, thereby causing the heavily catalyst-laden mixture RM to flow through cyclone 22, upwardly in vertical separator member 36 and out vent 40. Because the surging reaction mixture RM is discharged into the relatively large volume of disengagement vessel 14, much of the pressure and catalyst surge is dissipated rather than propagated through secondary cyclone 26. This minimizes the destabilizing effects of the transient on downstream separation equipment such as secondary cyclone 26, thereby permitting secondary cyclone 26 to function more efficiently. Additionally, catalyst carryover is minimized because a portion of spent catalyst SC that would otherwise have to pass through flow disturbed cyclones 22 is discharged into disengagement vessel 14 rather than propagating through system 10 toward and possibly into the fractionator.

FIG. 4 illustrates an alternative embodiment of the invention in which reaction mixture RM undergoes a preliminary disengagement step before entering primary cyclones 22. In this embodiment, riser reactor 12 discharges reaction mixture RM upwardly into a reactor shroud 52 located concentrically around riser reactor 12. Spent catalyst SC present in mixture RM impacts on and reverses flow within generally closed shroud upper member 54, causing a fraction of spent catalyst particles SC to move downwardly toward spent catalyst bed SCB through an annular region 56 formed between reactor 12 and shroud 54. Hydrocarbon vapors and spent catalyst not separated from mixture RM in the preliminary disengagement step pass through shroud discharge conduits 58 into primary cyclones 22 for further separation as discussed in conjunction with FIG. 1. It should be noted that the lower end of shroud 52 should remain submerged in spent catalyst bed SCB during cracking operations so that a generally closed vapor path is maintained between riser reactor 12 and reactor outlet plenum 32. The embodiment illustrated in FIG. 4 may be preferred in some instances as the use of the preliminary disengagement device causes cyclones 22 and 26 to be less heavily loaded.

While separator separator members 36 and 38 have been illustrated in FIGS. 1–4 as generally vertical and horizontal, respectively, it is only necessary that first and second members 36 and 38 define an included angle sufficient to permit the momentum of catalyst particles SC to carry particles SC through separator vent 40 while allowing cracked hydrocarbon vapors to flow from first member 31 into second member 38.

In some cases, either first of second members 36 or 38 may be the inlet or outlet piping of disengagement equipment. In other cases, pre-existing closed vapor path systems may be modified to include a post-cyclonic inertial separator. For example, if a closed vapor path reactor system already includes two conduits located after a cyclone separator and defining a suitable included angle, the benefits of post-cyclone inertial separation may be obtained simply by adding a vent at the downstream end of the upstream conduit to allow catalyst particles to shoot out the vent during operation. In this case as other cases, separator performance may be improved by extending the first member 36 slightly beyond the point where the first and second separator members join to provide a vent extension 36' like those shown in FIGS. 1, 4 and 5.

Separator members 36 and 38 can be conduits of any convenient cross-sectional geometry and can be formed from the same materials as used to construct other reactor system piping. Type 304 stainless steel having about 18 percent chromium and 8 percent nickel is one suitable material. Use of such a material should minimize both oxidation and sulfur-promoted corrosion which might otherwise occur within the disengagement vessel environment.

Care should be taken to ensure that catalyst impingement points within and external to separators 24 are protected from the erosive effects of continuous catalyst impingement. Impingement points within and external to the separator can be protected from erosion by a hexsteel coating filled with an erosion resistant refractory such as phosphate-bonded alumina or by wear pads constructed from a hard cobalt, tungsten and chromium alloy such as stellite. Where were pads are employed, a liner should be applied between the wear pad and the base metal to prevent base metal cracking. In most cases, it is preferred that inertial separator vent 40 be as wide as the inner diameter of first separator member 36 so that most discharged catalyst particles do not impinge directly on the inner surface of the first separator member 36.

Figure 5:
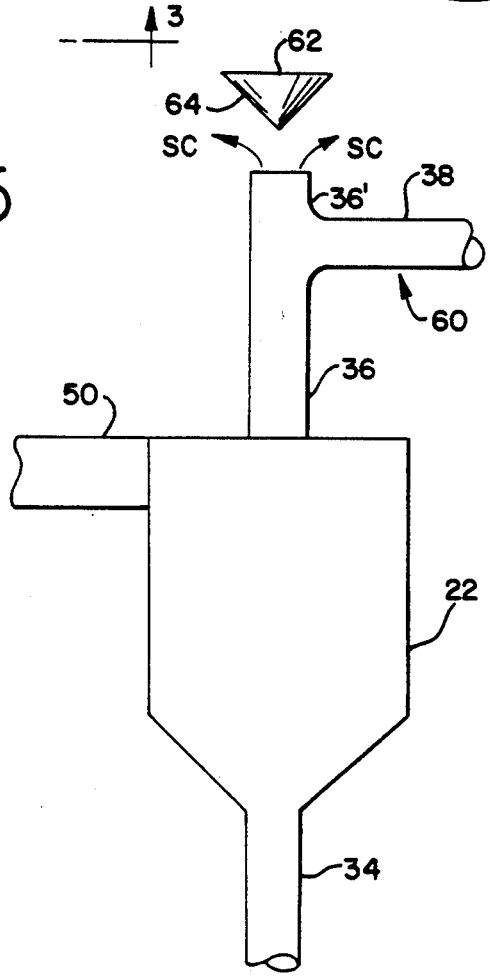
FIG. 5 is a partial sectional view of another embodiment of the invention which includes a catalyst deflector located near the inertial separator vent for directing the flow of disengaged catalyst within the disengagement vessel.

FIG. 5 illustrates another embodiment of inertial separator 60 that includes a catalyst deflector 62 located near inertial separator vent 40. Deflector 62 redirects spent catalyst SC exiting vent 40 so that the effects of catalyst impingement within disengagement vessel 14 can be controlled. Deflector 62 includes a curved or angled catalyst-deflecting surface 64 which redirects catalyst flow away from critical reactor system components and/or towards a desired catalyst impingement or accumulation region within system 10. If first inertial separator member 36 is generally vertically oriented as shown, deflector 62 provides the added advantage of preventing upwardly discharged catalyst from falling back toward and possibly into vent 40. Surface 64 of deflector 62 should be covered with hexsteel or wear pads as already discussed to minimize the effects of continuous catalyst impingement. Deflector 64 can be supported by any convenient means, but it is preferred that the support not be located in the path of catalyst deflected by surface 64.

It should be understood that while FIGS. 1–5 illustrate preferred embodiments of the invention in which vertical and horizontal members meet at a generally right angle, the momentum effects and pressure differentials exploited by the invention permit the invention to operate successfully in other orientations as discussed herein. It should also be understood that while the illustrated embodiments show an inertial separator located between a primary and secondary cyclone, the secondary cyclone need not be included to obtain many of the advantages of the invention. Therefore, the scope of the invention is intended to be limited only by the following claims.

We claim:

1. A method for catalytically cracking hydrocarbon vapors comprising the steps of:

introducing heated cracking catalyst and a hydrocarbon feedstock into a riser reactor located at least partially within a surrounding disengagement vessel;

allowing the catalyst and feedstock to react as they rise toward an outlet end of the riser reactor;

passing a reaction mixture of cracked vapors and spent catalyst along a generally closed vapor path from the riser reactor outlet end through a first cyclone separator located within the disengagement vessel to produce a catalyst-depleted reaction mixture;

passing the catalyst-depleted reaction mixture through a vented non-cyclonic inertial separator located downstream of the first cyclone separator and within the disengagement vessel to create a further catalyst-depleted reaction mixture; and passing the further catalyst-depleted mixture exiting the inertial separator through a generally closed vapor path located within and surrounded by the disengagement vessel into a second cyclone separator to disengage catalyst from the further catalyst-depleted mixture.

2. The method of claim 1 wherein the inertial separator vent opens into the disengagement vessel, and further comprising the step of allowing a stripping gas present in the disengagement vessel to enter the inertial separator through an inertial separator vent.

3. The method of claim 2 further including the step of performing an initial catalyst disengagement by discharging the reaction mixture into the upper end of a closed-topped reactor shroud located within the disengagement vessel located over and concentrically around an upper portion of the riser reactor.

4. The method of claim 3 wherein the shroud has an open bottom and further including the step of allowing disengaged catalyst to accumulate within the disengagement vessel around the shroud open bottom end.

5. The method of claim 4 further including the steps of:

passing stripping steam through the accumulated catalyst to strip hydrocarbon vapors from the disengaged catalyst; and allowing stripping steam and stripped hydrocarbon vapors to enter the inertial separator through an inertial separator vent.

6. The method of claim 1 further including the step of using a deflector to deflect catalyst disengaged by the inertial separator.

7. A method for disengaging spent cracking catalyst from a reaction mixture of spent catalyst and hydrocarbon vapors comprising the steps of:

passing the reaction mixture into a first cyclone separator located within a surrounding disengagement vessel to disengage spent catalyst, thereby producing a catalyst-depleted reaction mixture;

passing the catalyst-depleted reaction mixture along a closed vapor path into a first non-cyclonic inertial separator member located downstream of the first cyclone and within the disengagement vessel, said first member having a separator vent located at its downstream end for allowing catalyst to disengage from the mixture by passing through the vent, thereby forming a further catalyst-depleted reaction mixture;

passing the further catalyst-depleted reaction mixture into a second inertial separator member located within the disengagement vessel joined to the first member near a downstream end of the first member at an angle sufficient to prevent a fraction of catalyst particles moving through the first member toward the vent from entering the second member; and passing the further catalyst-depleted reaction mixture along a closed vapor path into a second cyclone separator to disengage additional catalyst from the further catalyst-depleted mixture.

8. The method of claim 7 wherein the first separator member is generally vertical and the second separator member is generally horizontal.

9. The method of claim 7 wherein the angle between the first and second inertial separator members is between about 30 and 150 degrees.

10. The method of claim 7 further including the steps of:

allowing spent catalyst to accumulate within a lower portion of the disengagement vessel;

using steam to strip hydrocarbon vapors from the accumulated spent catalyst, thereby forming a stripping gas comprising steam and stripped hydrocarbon vapors; and removing the stripping gas from the disengagement vessel by allowing the stripping gas to enter the inertial separator vent.

11. The method of claim 7 further including the step of using a deflector to deflect catalyst disengaged by the inertial separator.

12. A method for catalytically cracking hydrocarbon vapors comprising the steps of:

introducing heated cracking catalyst and a hydrocarbon feedstock into a riser reactor located within a disengagement vessel;

allowing the catalyst and feedstock to react at they rise toward an outlet end of the riser reactor;

passing a reaction mixture of cracked vapors and spent catalyst along a generally closed vapor path from the riser reactor outlet end into a first cyclone separator located within the disengagement vessel to produce a catalyst-depleted reaction mixture;

passing the catalyst-depleted reaction mixture through a non-cyclonic inertial separator located within the disengagement vessel, the inertial separator having a first generally vertical inertial separator member located downstream of the first cyclone, the first member having a separator vent located at its downstream end for allowing catalyst to disengage from the mixture by passing through the vent, thereby forming a further catalyst-depleted reaction mixture;

passing the further catalyst-depleted reaction mixture through a generally horizontal second inertial separator member joined to the first inertial separator member near the downstream end of the first member;

allowing stripping gas present in the disengagement vessel to pass into the inertial separator through the separator vent; and passing the further catalyst-depleted reaction mixture through a closed vapor path into a second cyclone separator to disengage additional catalyst from the further catalyst-depleted mixture.

13. The method of claim 12 further including the steps of:

initially discharging the reaction mixture from the riser reactor into the upper end of a closed-topped reactor shroud located within the disengagement vessel and concentrically around an upper portion of the riser reactor; and transporting a catalyst-depleted reaction mixture from the shroud to the first cyclone along a generally closed vapor path.

* * * * *